US005887784A

United States Patent [19]

Haas

[11] Patent Number: 5,887,784

[45] Date of Patent: Mar. 30, 1999

[54] DESICCANT DEVICE AND HUMIDITY MEASURING MEANS

[75] Inventor: Matthias Haas, Mettmenstetten, Switzerland

[73] Assignee: Electrowatt Technology Innovation AG, Zug, Switzerland

[21] Appl. No.: 886,219

[22] Filed: Jul. 1, 1997

[51] Int. Cl.[6] ..... B01F 3/02; G01N 7/00

[52] U.S. Cl. ..... 236/44 A; 73/23.21; 73/29.02

[58] Field of Search ..... 73/29.02, 23.21; 234/44 A; 62/176.4

[56] References Cited

U.S. PATENT DOCUMENTS

| | | | |
|---|---|---|---|
| 2,489,455 | 11/1949 | Leone | 73/29.02 |
| 3,009,684 | 11/1961 | Munters | 62/271 X |
| 3,247,679 | 4/1966 | Meckler | 62/271 |
| 3,488,971 | 1/1970 | Meckler | 62/3.4 |
| 4,594,860 | 6/1986 | Coeller et al. | 62/271 |
| 4,719,761 | 1/1988 | Cromer | 62/94 |
| 4,809,537 | 3/1989 | Glover et al. | 236/44 A |
| 5,353,606 | 10/1994 | Yoho et al. | 62/271 |

*Primary Examiner*—William Wayner
*Attorney, Agent, or Firm*—Greer, Burns & Crain, Ltd.

[57] ABSTRACT

An apparatus is disclosed for an improved air conditioning system for admitting air from an exterior space, adjusting the temperature and humidity of the exterior air and delivering the adjusted air to an interior space of a structure. To compare the energy levels of these two air streams an improved device brings both air streams to the same temperature, so just the relative humidity has to be measured to know which of these two air streams has the higher or the lower energy level. Using the device in a control system for a desiccant wheel, at least two temperature sensors are eliminateable.

8 Claims, 2 Drawing Sheets

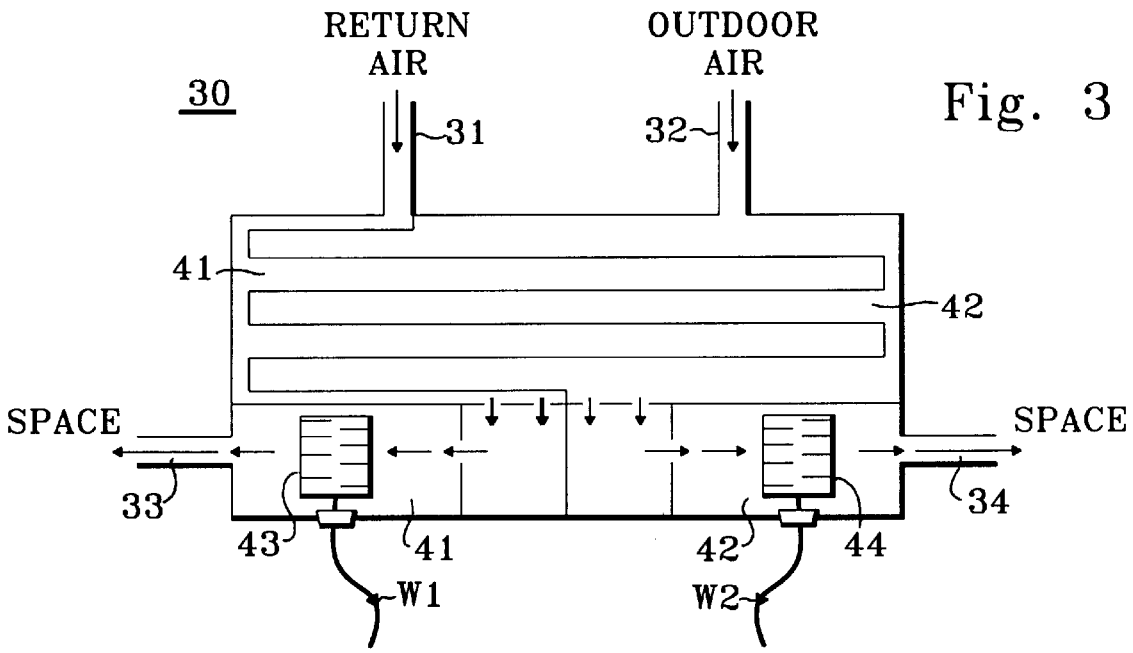
Fig. 3
Fig. 4
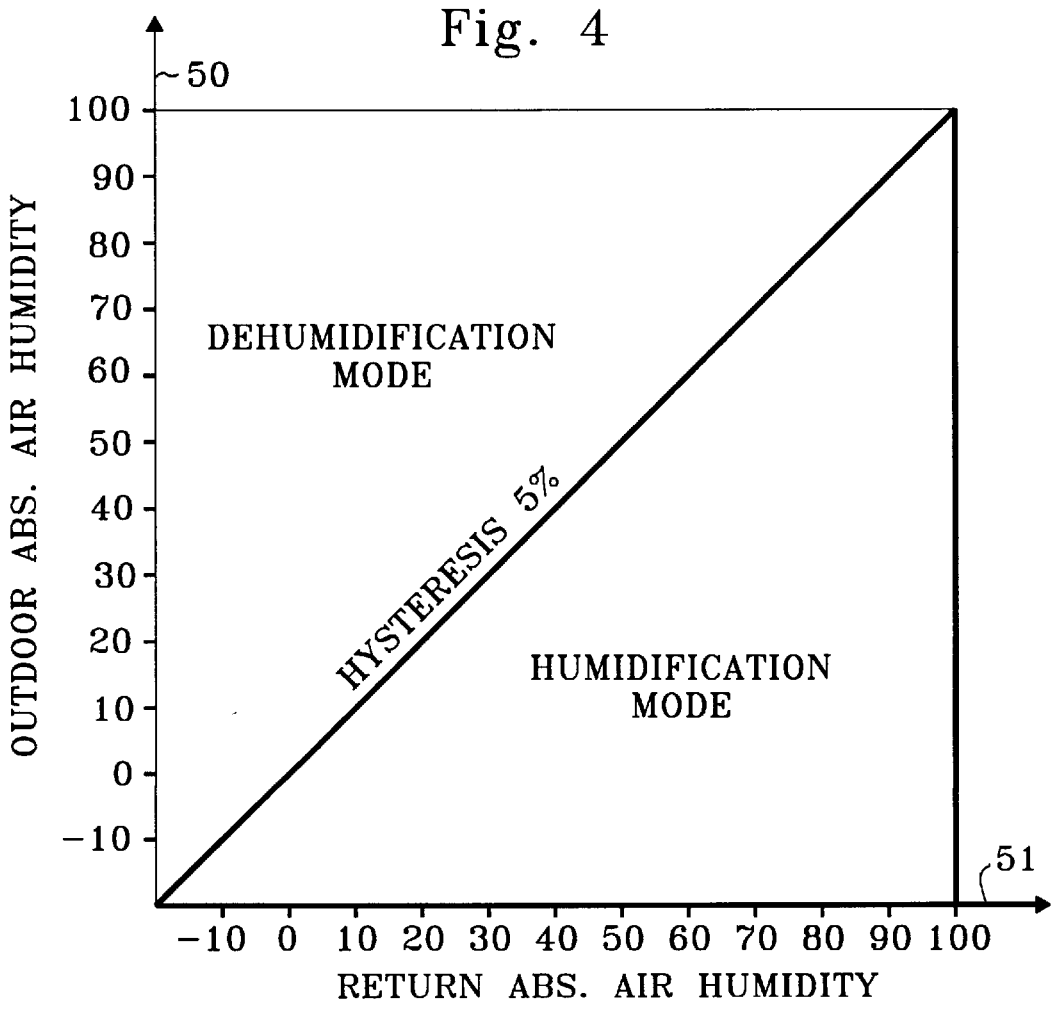

DESICCANT DEVICE AND HUMIDITY MEASURING MEANS

FIELD OF THE INVENTION

This invention relates to an improved air treatment system, and more in particular to a regenerative desiccant based air humidity controlling system.

BACKGROUND OF THE INVENTION

Air treatment systems, such as air conditioning and cooling systems, preferably include some means for controlling air humidity. Air humidity can be just as important to personal comfort as air temperature, especially in sunny regions close to open water. Also, air humidity control can be important for the protection of sensitive electronics, ancient art treasures etc.

Whereas raising air humidity is a relatively straightforward operation, it takes a lot more to bring it down for the purposes described above.

Various methods exist for bringing down air humidity. The spraying of certain chemicals is an non-repeatable and comparatively expensive method with many additional disadvantages. In general, a repeatable method is preferred, in the sense that no refuelling is needed, other than a possible energy supply. Air cooling means may indeed effect a repeatable drying of air, but since that is inevitably coupled to the cooling thereof, it will in itself not allow enough flexibility and fine-adjustment to meet the needs of most applications described above. On top of that, it makes for a relatively inefficient and therefore expensive air drying process.

More sophisticated desiccant means have therefore been developed, that are often but not always used as part of an air cooling system. Best described are the so-called desiccant wheels, that can for instance be found in U.S. Pat. No. 5,353,606, U.S. Pat. No. 4,719,761, U.S. Pat. No. 4,594,860, U.S. Pat. No. 3,488,971, U.S. Pat. No. 3,247,679 and U.S. Pat. No. 3,009,684, all deemed to be incorporated by reference. The thermodynamic process involved in operating these desiccant wheels are also described therein. Examples of the active chemical compound used in such desiccant wheels are silica-gel and lithium chloride.

Most air humidity controlling systems need some form of control over the level of activity employed at any given time. When drawing outside air, the humidity and temperature thereof vary and influence the end result. Also, the end result itself may have to be adjusted from time to time, for instance depending on personal preference in the case of comfort control. All forms of level control in an air humidity controlling system require measurement of air humidity, be it of the end result, be it at some intermediate stage, be it of the outside air.

Air humidity measurement is usually performed by comparing the air humidity in two different areas that indicate the air humidity before and after treatment with the desiccant means. The comparison in turn gives an indication of the preferred level of activity. For instance, one area could be somewhere within a duct for transporting outside air to the inside of a building, and the other area in another duct serving the opposite purpose. Or one area could be the inside of the building itself, so that the end result of the air humidity control is being measured, and the other measurement could then possibly be performed outside, in order to give the system an indication of the difference that should be bridged. In theory, one humidity sensor placed in between the two different areas of measurement may do the job. However, the most practical solutions so far make use of two separate humidity sensors, each located with either of the two measuring areas.

SUMMARY OF THE INVENTION

The invention relates to air humidity controlling systems in which air humidity is measured in at least two different areas. Measuring air humidity at the random temperature, air pressure and air speed that may commonly occur in areas in and around air humidity controlling systems, sets high requirements to the quality of the humidity sensor or humidity sensors involved. In particular, a sensor should be gauged and should give representative output within the whole range of temperatures, pressures and wind shield factors to be expected. Temperatures in both areas constantly and independently fluctuate with the weather, the required end result, the level of activity of the desiccant means itself and of humidifiers close by (since drying and moisturising air influences the temperature thereof), the presence of water damp sources at the output, the demands made to the system, any heat sources nearby, to name a few. Air pressures in both areas constantly and independently fluctuate with the weather, fan activity, the required end result, and the demands made to the system. The same holds true for air speed.

Surprisingly, it is now made possible to use more simple and cheaper humidity sensors in air humidity controlling systems, some of which sensors have been on the market for longer than air humidity controlling systems. Also, the humidity sensor or humidity sensors involved need not necessarily be as accurate as before to obtain the same quality end result. This has been achieved with a desiccant device according to the invention, comprising a division means for at least locally substantially isolating at least two areas from each other, at least one desiccant means for removing moisture from air in the first of said areas, and for transporting said moisture to the second of said areas, humidity sensing means for obtaining the humidity difference between air from said first area and air from said second area, first air transport means for transporting air from said first area to said humidity sensing means, second air transport means for transporting air from said second area to said humidity sensing means, a control means for controlling the level of activity of said desiccant means in response to the output of said humidity sensing means, wherein said first air transport means and said second air transport means comprise a temperature equalising means for substantially equalising the temperatures of the air from said first area and of the air from said second area before completing the transport to said humidity sensing means.

In a preferred embodiment of the invention, the desiccant device comprises humidity sensing means that comprise at least one humidity sensor for sensing relative humidity. For all practical purposes, if the air temperatures are equal, an equality of relative humidity in equals the equality of absolute humidity. Applying this rule while realising that it predominantly is absolute humidity that needs to be controlled, and combining this with the insight that, for all practical purposes here, air temperatures can easily be made sufficiently equal, has lead to this preferred embodiment of the invention.

In a further preferred embodiment of the invention the desiccant device comprises humidity sensing means that comprise a first humidity sensor for sensing the humidity of air from said first area and a second humidity sensor for sensing the humidity of air from said second area.

In a yet further preferred embodiment of the invention the desiccant device comprises control means that provides substantially the same response to any level of output of said humidity sensing means indicating a positive humidity difference between air from said first area and air from said second area, and provides substantially the same reverse response to any level of output of said humidity sensing means indicating a negative humidity difference. It has been found that simply measuring which of the humidities of both areas is higher, already provides enough data to effectively control the desiccant device of this preferred embodiment of the invention. This allows for cheaper humidity sensors and less complicated control means.

Most effectively for the reason of keeping the control means as simple as can be, the desiccant device according to a further preferred embodiment of the invention comprises a heat exchanger as temperature equalising means. Alternatively, it may be attractive to save on material by using a heating means instead of or in combination with a (smaller) heat exchanger, according to another preferred embodiment of the invention. More specifically, an electrical heating resistor is even more preferred because it can be controlled relatively easy and in quick response by electronic control means of the desiccant device.

The invention is also incorporated in a humidity measuring means, comprising humidity sensing means for obtaining the humidity difference between air from a first area and air from a second area, first air transport means for transporting air from said first area to said humidity sensing means, second air transport means for transporting air from said second area to said humidity sensing means, wherein said first air transport means and said second air transport means comprise a temperature equalising means for substantially equalising the temperatures of the air from said first area and of the air from said second area before completing the transport to said humidity sensing means.

BRIEF DESCRIPTION OF THE DRAWINGS

FIG. 3 shows in detail the measuring means for determining the absolute humidity of both the outdoor air and of the return air.

FIG. 4 shows a diagram of the operation of the controller unit.

DETAILED DISCUSSION

Figure 1:
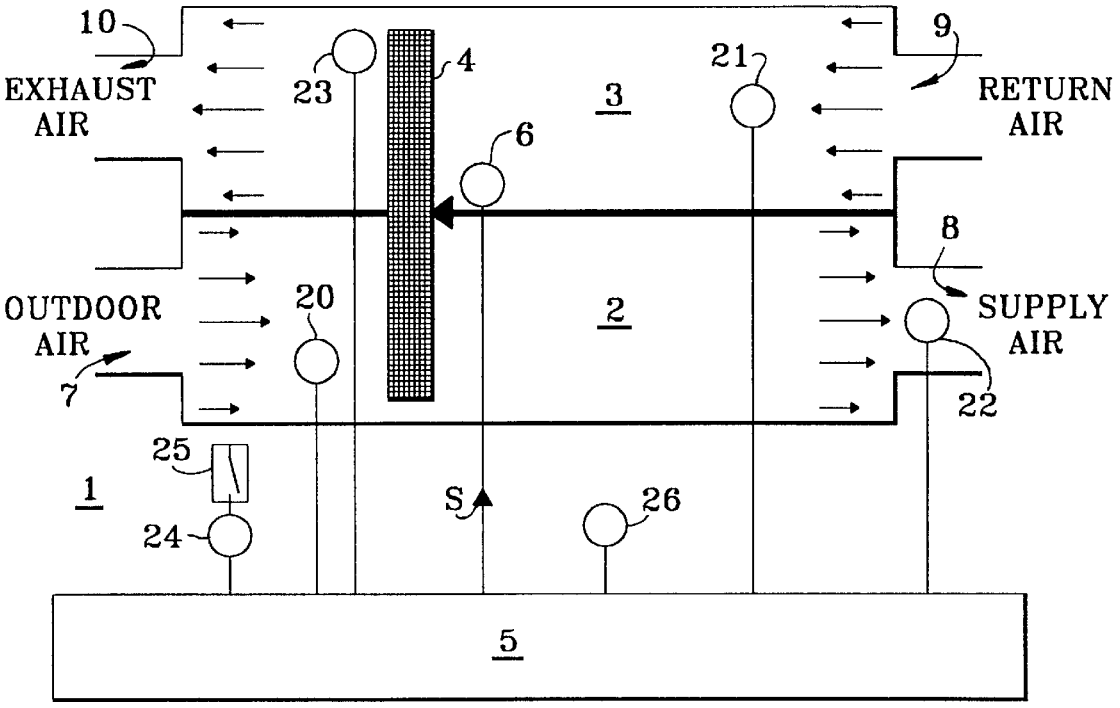
FIG. 1 shows the principles of the operation of a system for controlling the humidity of air. The system comprises sensors for measuring the absolute humidity of fresh, outdoor air and sensors for measuring the absolute humidity of return air as well as a controller unit.

FIG. 1 shows a system 1 for controlling the humidity of air in a first air duct 2 and a second air duct 3 whereby both air ducts 2 and 3 are connected to each other via an enthalpy wheel 4. The system 1 further comprises a control unit 5 via which a control signal S for controlling or regulating a drive unit 6 of the enthalpy wheel 4 is generated.

Via the operation of system 1 outdoor air flows through the first air duct 2 into a building whereby the outdoor air flows through a first inlet 7 in the first air duct 2 and subsequently flows through a first outlet 8 into the building. Correspondingly, via the operation of system 1, return air flows through the second air duct 3 whereby the return air flows through a second inlet 9 in the second air duct 3 and subsequently flows out of the building through a second outlet 10.

The controller unit 5 is connected to a first sensor 20 and a second sensor 21, whereby the first sensor 20 can measure the absolute humidity of the air between the first inlet 7 and the enthalpy wheel 4 and also whereby the second sensor 21 can measure the absolute humidity of the air between the second inlet 9 and the enthalpy wheel 4.

Furthermore the controller unit 5 is connected to a third sensor 22 and with a fourth sensor 23, whereby the third sensor 22 can measure the absolute humidity of the air between the enthalpy wheel 4 and the first outlet 8 and also whereby the fourth sensor 23 can measure the absolute humidity of the air between the second outlet 10 and the enthalpy wheel 4.

According to the requirement the system 1 is activated or de-activated by the controller unit 5 via a signal input 24 and/or a switch 25 and/or a stop button 26.

The implementation of both sensors 20 and 21 for measuring the absolute humidity of the air by means of the currently known method is non-trivial and relatively expensive.

Figure 2:
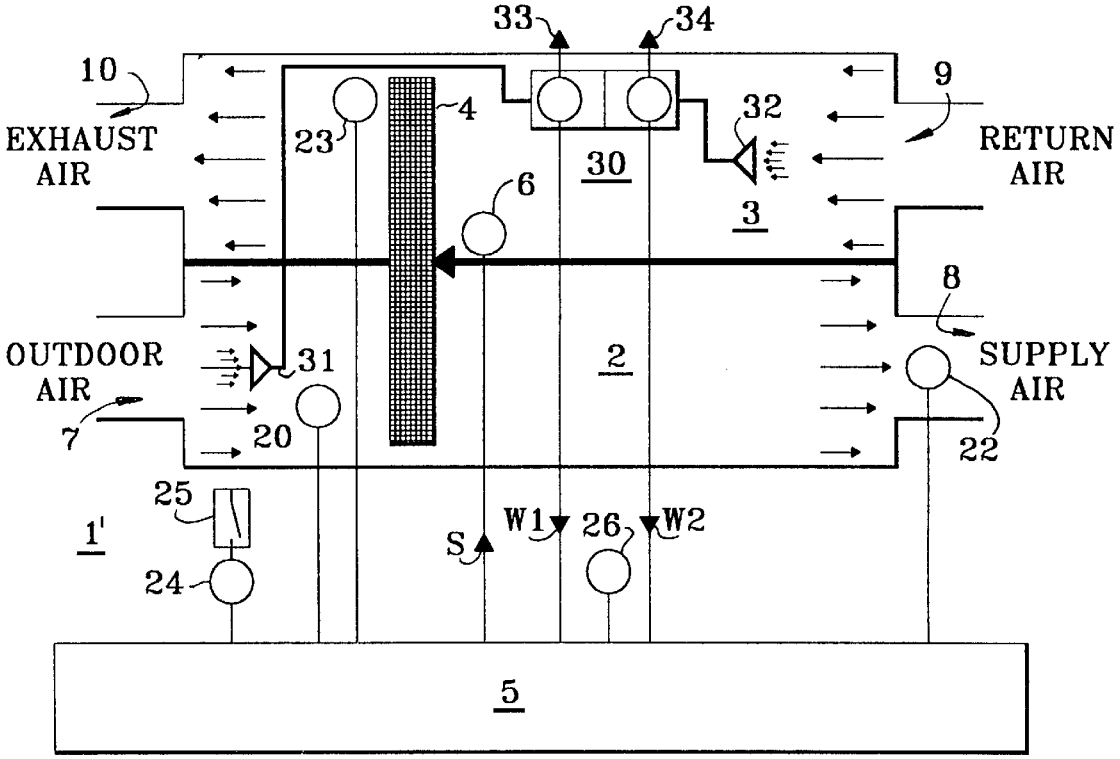
FIG. 2 shows an invention for a system for controlling the humidity of air. The system comprises a measuring means for determining the absolute humidity of both the outdoor air and of the return air.

According to the invention, FIG. 2 shows a system 1 for controlling the humidity of air with a controller unit 5 connected to a measuring means 30, through which the absolute humidity of air is determinable in the first air duct 2 and in the second air duct 3, whereby the absolute humidity of the flow in air ducts 2 and 3 is measured before entry to the enthalpy wheel 4. The measuring means 30 has a first inlet tube 31 and a second inlet tube 32 whereby both inlet tubes 31 and 32 in the system 1 are installed in a particular way such that via the first inlet tube 31 air is sampled from a zone between the first inlet 7 and the enthalpy wheel 4 and similarly, via the second inlet tube 32, air is sampled from a zone between the second inlet 9 and the enthalpy wheel 4. The measuring means 30 has outlet tubes 33 and 34, out through which the air from inlet tubes 31 and 32 respectively is exhausted. The measuring means 30 generates a first signal WI and a second signal W2 whereby the first signal WI corresponds to the value of the absolute humidity of the air in the zone between the first inlet 7 and the enthalpy wheel 4 and the second signal corresponds to the value of the absolute humidity of the air in the zone between the second inlet 9 and the enthalpy wheel 4. Both signals WI and W2 are fed to the controller unit 5.

In FIG. 3 is shown the improved measuring means 30 between the first inlet tube 31 and the first outlet tube 33 of a first channel 41 and between the second inlet tube 32 and the second outlet tube 34 of a second channel 42. At one end of the first channel 41, next to the first outlet tube 33, is installed a first humidity sensor 43 whilst at an end of the second channel 42, next to the second outlet tube 34, is installed a second humidity sensor 44.

Both channels 41 and 42 form a heat exchanger which functions such that the air in the first humidity sensor 43 is equalized in temperature with the air in the second humidity sensor 44. The heat exchanger 41, 42 functions such that both humidity sensors 43 and 42 measure the humidity of their respective air streams at the same temperature, independent of how big is the temperature difference between the air sampled by the first inlet tube 31 and the air sampled by the second inlet tube 32. The heat exchanger 41, 42 is advantageously realized as a plate heat exchanger.

Via the measuring means 30 and the heat exchanger 41, 42 the temperatures of the sampled air flows from the first air duct 2 and from the second air duct 3 are equalized. By this temperature equalization, the absolute humidity difference can be cost effectively (indirectly) measured. The cost reduction results from the fact that when the temperatures of the two air samples are equalized, the determination of the difference in absolute humidity is (indirectly) measured with two simple relative humidity sensors 43 and 44. Even though the absolute humidity is a function of both relative humidity and temperature the application of two additional temperature sensors for determining the air temperature in the zone of the first inlet 7 and in the zone of the second inlet 9—or the application of two expensive sensors 20 and 21 for measuring the absolute humidity of the air—is unnecessary.

The two humidity sensors 43 and 44 are advantageously realized as resistive humidity sensors. Resistive humidity sensors for measuring relative humidity exhibit an electrical resistance which is strongly dependent upon the humidity of the surrounding air. Resistive humidity sensors for measuring relative humidity are very cheap compared with sensors which are used to measure absolute humidity. In the control unit 5 the absolute humidity of the outdoor air is compared with the absolute humidity of the return air. The control unit 5 has at least two operational modes namely a dehumidification mode and a humidification mode.

In FIG. 4, the absolute humidity of the outdoor air is represented on the ordinate 50 and the absolute humidity of the return air is represented on the abscissa. The control unit 5 operates in the dehumidification mode when the absolute humidity of the outdoor air is greater than the absolute humidity of the return air. The controller 5 operates in the humidification mode when the absolute humidity of the outdoor air less than the absolute humidity of the return air. The hysteresis switching between the two modes is beneficially adjustable and has a value of 5% for example.

In the dehumidification mode the enthalpy wheel is controlled by the controller unit 5 such that the enthalpy wheel transfers the humidity of the air in the first air duct 2 to the air in the second air duct 3 whereby air in the first outlet 8 is less humid than the air in the first inlet 7.

In humidification mode the enthalpy wheel 4 is controlled via the control unit 5 such that the enthalpy wheel transfers energy out of the warm air from the second air duct 3 to the outdoor air in the first air duct 2.

What is claimed is:

1. A desiccant device, comprising:

a division means for at least locally substantially isolating at least two areas from each other;

at least one desiccant means for removing moisture from air in the first of said areas, and for transporting said moisture to the second of said areas;

humidity sensing means for obtaining the humidity difference between air from said first area and air from said second area;

first air transport means for transporting air from said first area to said humidity sensing means;

second air transport means for transporting air from said second area to said humidity sensing means; and a control means for controlling the level of activity of said desiccant means in response to the output of said humidity sensing means, wherein said first air transport means and said second air transport means are in a heat exchanging relationship to one another and comprise a temperature equalising means for substantially equalising the temperatures of the air from said first area and of the air from said second area before completing the transport to said humidity sensing means.

2. A desiccant device according to claim 1 wherein said humidity sensing means comprises at least one humidity sensor for sensing relative humidity.

3. A desiccant device according to claim 2 wherein said humidity sensing means comprise a first humidity sensor for sensing the humidity of air from said first area and a second humidity sensor for sensing the humidity of air from said second area.

4. A desiccant device according to claim 1 wherein said control means provides substantially the same response to any level of output of said humidity sensing means indicating a positive humidity difference between air from said first area and air from said second area, and provides substantially the same reverse response to any level of output of said humidity sensing means indicating a negative humidity difference.

5. A desiccant device according to claim 1 wherein said temperature equalising means further comprise a heat exchanger.

6. Humidity measuring means, comprising:

humidity sensing means for obtaining the humidity difference between air from a first area and air from a second area;

first air transport means for transporting air from said first area to said humidity sensing means; and second air transport means for transporting air from said second area to said humidity sensing means wherein said first air transport means and said second air transport means are in a heat exchanging relationship to one another and comprise a temperature equalising means for substantially equalising the temperatures of the air from said first area and of the air from said second area before completing the transport to said humidity sensing means.

7. Humidity measuring means according to claim 6 wherein said humidity sensing means comprises at least one humidity sensor for sensing relative humidity.

8. A desiccant device according to claim 7 wherein said humidity sensing means comprise a first humidity sensor for sensing the humidity of air from said first area and a second humidity sensor for sensing the humidity of air from said second area.

* * * * *